US007876904B2

(12) United States Patent
Ojala et al.

(10) Patent No.: US 7,876,904 B2
(45) **Date of Patent: *Jan. 25, 2011**

(54) DYNAMIC DECODING OF BINAURAL AUDIO SIGNALS

(75) Inventors: Pasi Ojala, Kirkkonummi (FI); Julia Turku, Espoo (FI)

(73) Assignee: Nokia Corporation, Espoo (FI)

( * ) Notice: Subject to any disclaimer, the term of this patent is extended or adjusted under 35 U.S.C. 154(b) by 1217 days.

This patent is subject to a terminal disclaimer.

(21) Appl. No.: 11/456,191

(22) Filed: Jul. 8, 2006

(65) Prior Publication Data

US 2008/0008327 A1 Jan. 10, 2008

(51) Int. Cl.
*H04R 5/00* (2006.01)

(52) U.S. Cl. ..... 381/20; 381/17; 381/21; 381/22; 381/23

(58) Field of Classification Search ..... 381/1, 381/2, 309–310, 17–23, 74, 27; 704/500–504
See application file for complete search history.

(56) References Cited

U.S. PATENT DOCUMENTS

| | | | | |
|---|---|---|---|---|
| 7,167,567 | B1 * | 1/2007 | Sibbald et al. | 381/17 |
| 2003/0035553 | A1 | 2/2003 | Baumgarte et al. | |
| 2003/0219130 | A1 * | 11/2003 | Baumgarte et al. | 381/17 |
| 2005/0180579 | A1 * | 8/2005 | Baumgarte et al. | 381/63 |
| 2006/0083385 | A1 | 4/2006 | Allamanche et al. | |
| 2006/0085200 | A1 | 4/2006 | Allamanche et al. | |
| 2006/0115100 | A1 | 6/2006 | Faller | |
| 2006/0206323 | A1 * | 9/2006 | Breebaart | 704/230 |
| 2007/0067162 | A1 | 3/2007 | Villemoes et al. | 704/206 |
| 2008/0130904 | A1 | 6/2008 | Faller | 381/17 |
| 2008/0167880 | A1 | 7/2008 | Seo et al. | 704/500 |

FOREIGN PATENT DOCUMENTS

| | | | |
|---|---|---|---|
| EP | 1565036 | A2 * | 8/2005 |
| WO | WO 991938 | A1 * | 6/1999 |
| WO | 2005/043511 | | 5/2005 |

(Continued)

OTHER PUBLICATIONS

Frank Baumgarte and Christof Faller, Binaural Cue Coding-Part I: Psychoacoustic Fundamentals and Design Principles, IEEE Transactons on speech and audio processing, vol. 11, No. 6, Nov. 2003.*

(Continued)

*Primary Examiner*—Xu Mei
*Assistant Examiner*—Friedrich Fahnert

(57) ABSTRACT

Inputting of a parametrically encoded audio signal comprising at least one combined signal of a plurality of audio channels and one or more corresponding sets of side information describing a multi-channel sound image and including channel configuration information is shown along with deriving, from the channel configuration information, audio source location data describing at least one of horizontal and vertical positions of audio sources in the binaural audio signal; selecting, from a predetermined set of head-related transfer function filters, a left-right pair of head-related transfer function filters matching closest to the audio source location data, wherein the left-right pair of head-related transfer function filters is searched in a stepwise motion in a horizontal plane; and synthesizing a binaural audio signal from the at least one processed signal according to side information and the channel configuration information.

24 Claims, 4 Drawing Sheets

FOREIGN PATENT DOCUMENTS

| | | |
|---|---|---|
| WO | 2006/006809 | 1/2006 |
| WO | 2006/060279 | 6/2006 |

OTHER PUBLICATIONS

Frank Baumgarte and Christof Faller, Binaural Cue Coding-Part II: Schemes and Applcations, IEEE Transactons on speech and audio processing, vol. 11, No. 6, Nov. 2003.*

Frank Baumgarte and Christof Faller, Why Binaural Cue Coding is better than Intensity Stereo Coding, Audio Engineering Society, Convention Paper 5575, Presented at the 112th Convention, May 2002, Munich, Germany.*

ISO/IEC JTC 1/SC 29/WG 11/M13233, Apr. 2006, Montreux, Switzerland, Coding of Moving Pictures and Audio, "Further Information in binaural decoder functionality," Pasi Ojala, Julia Jakka.

IEEE Transactions on Speech and Audio Processing, vol. II, No. 6, Nov. 2003, "Binaural Cue Coding—Part I: Psychoacoustic Fundamentals and Design Principles," by Frank Baumgarte and Christof Faller.

IEEE Transactions on Speech and Audio Processing, vol. II, No. 6, Nov. 2003, Binaural Cue Coding—Part II: "Schemes and Applications," by Christof Faller and Frank Baumgarte.

International Search Report (4 pages) for International Application No. PCT/FI2007/050367 dated Oct. 12, 2007.

* cited by examiner

DYNAMIC DECODING OF BINAURAL AUDIO SIGNALS

BACKGROUND OF THE INVENTION

The present invention relates to spatial audio coding, and more particularly to controlling dynamic decoding of binaural audio signals.

In spatial audio coding, a two/multi-channel audio signal is processed such that the audio signals to be reproduced on different audio channels differ from one another, thereby providing the listeners with an impression of a spatial effect around the audio source. The spatial effect can be created by recording the audio directly into suitable formats for multi-channel or binaural reproduction, or the spatial effect can be created artificially in any two/multi-channel audio signal, which is known as spatialization.

It is generally known that for headphones reproduction artificial spatialization can be performed by HRTF (Head Related Transfer Function) filtering, which produces binaural signals for the listener's left and right ear. Sound source signals are filtered with filters derived from the HRTFs corresponding to their direction of origin. A HRTF is the transfer function measured from a sound source in free field to the ear of a human or an artificial head, divided by the transfer function to a microphone replacing the head and placed in the middle of the head. Artificial room effect (e.g. early reflections and/or late reverberation) can be added to the spatialized signals to improve source externalization and naturalness.

Binaural Cue Coding (BCC) is a highly developed parametric spatial audio coding method designed for multi-channel loudspeaker systems. The BCC encodes a spatial multi-channel signal as a single (or several) downmixed audio channel and a set of perceptually relevant inter-channel differences estimated as a function of frequency and time from the original signal. The method allows for a spatial audio signal mixed for an arbitrary loudspeaker layout to be converted for any other loudspeaker layout, consisting of either same or different number of loudspeakers. The BCC also enables to convert multi-channel audio signal for headphone listening, whereby the original loudspeakers are replaced with virtual loudspeakers by employing HRTF filtering and the loudspeaker channel signals are played through HRTF filters.

The document ISO/IEC JTC 1/SC 29/WG 11/M13233, Ojala P., Jakka J. "*Further information on binaural decoder functionality*", April 2006, Montreux, discloses an audio image rendering system designed for a binaural decoder, e.g. for a BCC decoder, wherein the decoder comprises a sufficient number of HRTF filter pairs to represent each possible loudspeaker position. The audio image rendering is carried out on the basis of the audio image control bit stream, which may consist of differential and absolute sound source (such as loudspeaker) locations, transmitted as side information to the decoder, according to which the HRTF filter pairs are selected. Thus, the content creator has more flexibility to design a dynamic audio image for the binaural content than for loudspeaker representation with physically fixed loudspeaker positions.

The above design offers very flexible and versatile variations for audio image rendering, provided that the decoder comprises a sufficient number of HRTF filter pairs. However, the binaural decoder standard does not mandate any particular HRTF set. Therefore, the content creation does not have any knowledge on the available HRTF filter database in the binaural decoder. Accordingly, the sound source location information carried along the audio image control bit stream may exceed or does not match exactly to the available HRTF filter set resolution in the binaural decoder. As a result, the decoder may omit the audio image control due to an incompatible HRTF filter set, whereby the perceived audio image may differ significantly from what was intended by the content creator.

BRIEF SUMMARY OF THE INVENTION

Now there is invented an improved method and technical equipment implementing the method, by which dynamic binaural control is made available even if the decoder contains only a limited set of HRTF filters. Various aspects of the invention include methods, an apparatus, a decoder, an encoder, computer program products and a module, which are characterized by what is stated in the independent claims. Various embodiments of the invention are disclosed in the dependent claims.

According to a first aspect, a method according to the invention is based on the idea of inputting a parametrically encoded audio signal comprising at least one combined signal of a plurality of audio channels and one or more corresponding sets of side information describing a multi-channel sound image and including channel configuration information; deriving, from said channel configuration information, audio source location data describing horizontal and/or vertical positions of audio sources in the binaural audio signal; selecting, from a predetermined set of head-related transfer function filters, a left-right pair of head-related transfer function filters matching closest to the audio source location data, wherein the left-right pair of head-related transfer function filters is searched in stepwise motion in a horizontal plane; and synthesizing a binaural audio signal from the at least one processed signal according to side information and said channel configuration information.

According to an embodiment, the angular velocity of the sound source movement is kept constant during the search of the left-right pair of head-related transfer function filters matching closest to the audio source location data.

According to an embodiment, the stepwise motion is carried out as 10 degrees or 20 degrees steps in horizontal plane in a plurality of elevations.

According to an embodiment, the method further comprises: monitoring whether the audio source location data implies a sound source movement crossing a singular position (zenith) in the sound image; and if affirmative, turning computationally the horizontal angle of the sound source location by 180 degrees after the singular position is crossed.

The arrangement according to the invention provides significant advantages. A major advantage is that due to the constant angular velocity of the sound source movement in the horizontal plane, the bitrate of the control information can be minimized. Moreover, the dynamic binaural control is available even if the decoder contains only a limited set of HRTF filters. From the content creation point of view the dynamic control can be reliably utilized, since the best possible approximation of the audio image is always achieved.

A second aspect provides a method for generating a parametrically encoded audio signal, the method comprising: inputting a multi-channel audio signal comprising a plurality of audio channels; generating at least one combined signal of the plurality of audio channels; and generating one or more corresponding sets of side information including channel configuration information for controlling audio source locations in a synthesis of a binaural audio signal, said channel configuration information including information for searching, from a predetermined set of head-related transfer function filters, a left-right pair of head-related transfer function filters matching closest to the audio source location data in stepwise motion during the synthesis of the binaural audio signal.

Thus, this aspect provides the content creator with a possibility to control, at least in some occasions, the use of the incremental steps in the binaural downmix, whereby the desired incremental steps and their direction are included in the channel configuration information of the bitstream in the encoder.

These and other aspects of the invention and the embodiments related thereto will become apparent in view of the detailed disclosure of the embodiments further below.

BRIEF DESCRIPTION OF THE DRAWINGS

In the following, various embodiments of the invention will be described in more detail with reference to the appended drawings, in which.

DETAILED DESCRIPTION OF EMBODIMENTS

In order to make the embodiments more tangible, the binaural decoder disclosed in the above-mentioned document "*Further information on binaural decoder functionality*", by Ojala P., Jakka J., and its operation is explained briefly herein. As background information for the binaural decoder, the concept of Binaural Cue Coding (BCC) is first briefly introduced as an exemplified platform for implementing the encoding and decoding schemes according to the embodiments. It is, however, noted that the invention is not limited to BCC-type spatial audio coding methods solely, but it can be implemented in any audio coding scheme providing at least one audio signal combined from the original set of one or more audio channels and appropriate spatial side information. For example, the invention may be utilized in MPEG surround coding scheme, which as such takes advantage of the BCC scheme, but extends it further.

Figure 1:
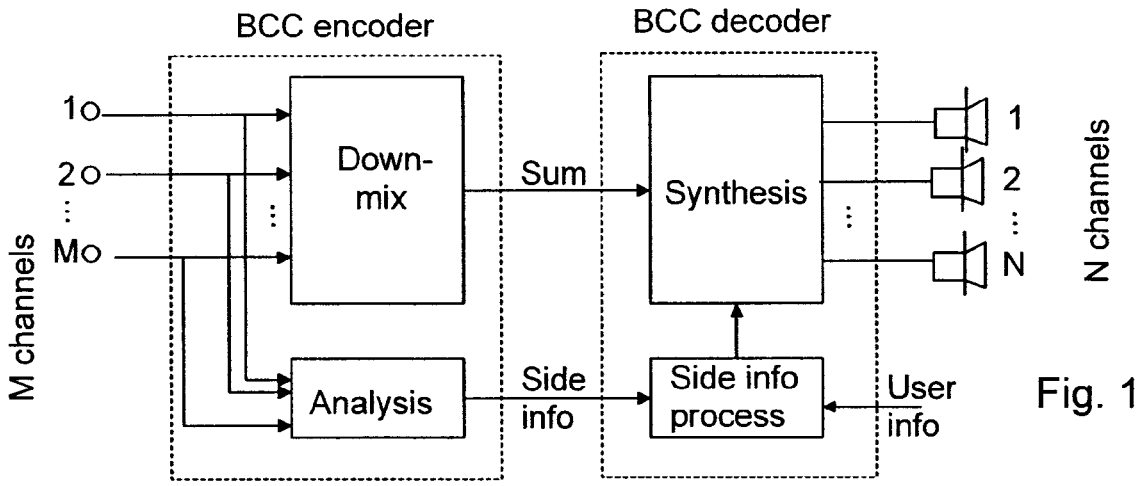
FIG. 1 shows a generic Binaural Cue Coding (BCC) scheme according to prior art.

Binaural Cue Coding (BCC) is a general concept for parametric representation of spatial audio, delivering multi-channel output with an arbitrary number of channels from a single audio channel plus some side information. FIG. 1 illustrates this concept. Several (M) input audio channels are combined into a single output (S; "sum") signal by a downmix process. In parallel, the most salient inter-channel cues describing the multi-channel sound image are extracted from the input channels and coded compactly as BCC side information. Both sum signal and side information are then transmitted to the receiver side, possibly using an appropriate low bitrate audio coding scheme for coding the sum signal. On the receiver side, the BCC decoder knows the number (N) of the loudspeakers as user input. Finally, the BCC decoder generates a multi-channel (N) output signal for loudspeakers from the transmitted sum signal and the spatial cue information by re-synthesizing channel output signals, which carry the relevant inter-channel cues, such as Inter-channel Time Difference (ICTD), Inter-channel Level Difference (ICLD) and Inter-channel Coherence (ICC). Accordingly, the BCC side information, i.e. the inter-channel cues, is chosen in view of optimizing the reconstruction of the multi-channel audio signal particularly for loudspeaker playback. BCC schemes result in a bitrate, which is only slightly higher than the bitrate required for the transmission of one audio channel, since the BCC side information requires only a very low bitrate (e.g. 2 kb/s).

Figure 2:
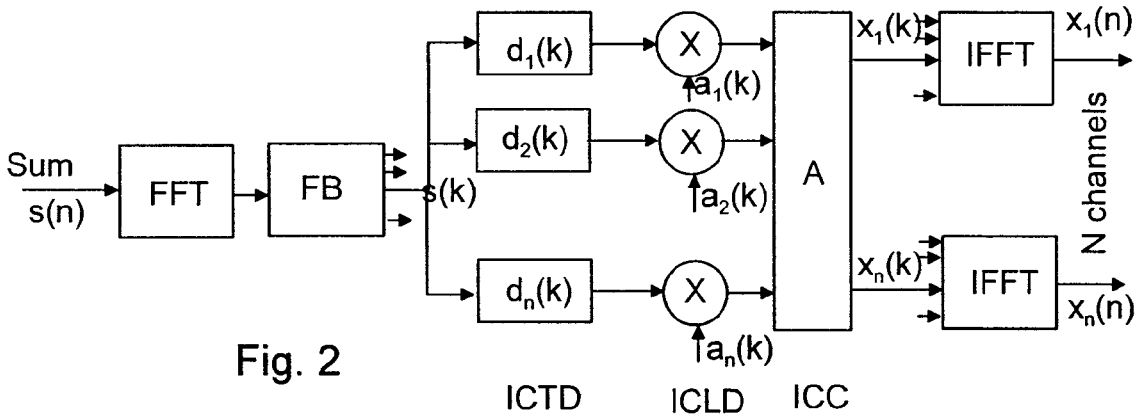
FIG. 2 shows the general structure of a BCC synthesis scheme according to prior art.

FIG. 2 shows the general structure of a BCC synthesis scheme. The transmitted mono signal ("sum") is first windowed in time domain into frames and then mapped to a spectral representation of appropriate subbands by a FFT process (Fast Fourier Transform) and a filterbank FB. Alternatively the time-frequency analysis can be done for example with QMF analysis. In the general case of playback channels the ICLD and ICTD are considered in each subband between pairs of channels, i.e. for each channel relative to a reference channel. The subbands are selected such that a sufficiently high frequency resolution is achieved, e.g. a subband width equal to twice the ERB scale (Equivalent Rectangular Bandwidth) is typically considered suitable. For each output channel to be generated, individual time delays ICTD and level differences ICLD are imposed on the spectral coefficients, followed by a coherence synthesis process which re-introduces the most relevant aspects of coherence and/or correlation (ICC) between the synthesized audio channels. Finally, all synthesized output channels are converted back into a time domain representation by an IFFT process (Inverse FFT) or alternatively with inverse QMF filtering, resulting in the multi-channel output. For a more detailed description of the BCC approach, a reference is made to: F. Baumgarte and C. Faller: "*Binaural Cue Coding*—Part I: *Psychoacoustic Fundamentals and Design Principles*"; IEEE Transactions on Speech and Audio Processing, Vol. 11, No. 6, November 2003, and to: C. Faller and F. Baumgarte: "*Binaural Cue Coding—Part II: Schemes and Applications*", IEEE Transactions on Speech and Audio Processing, Vol. 11, No. 6, November 2003.

Figure 3:
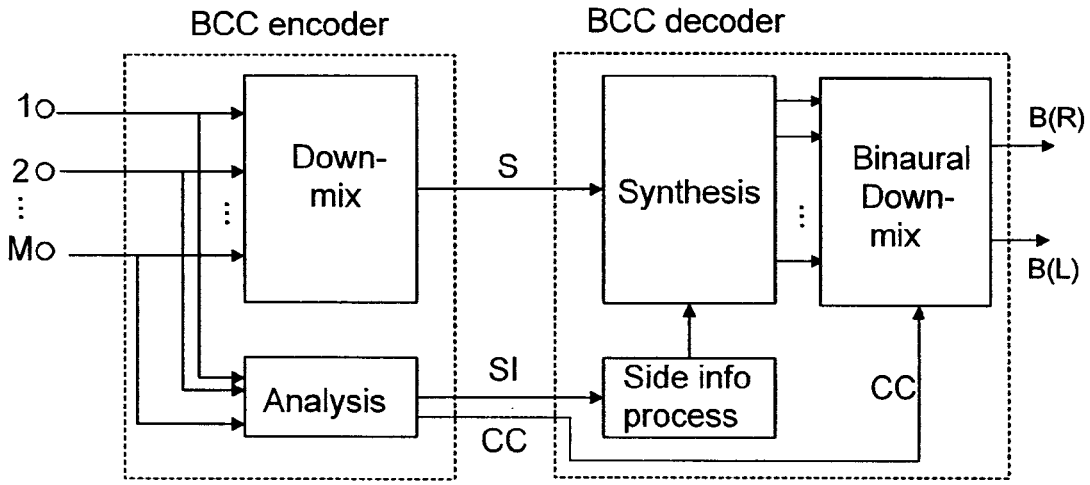
FIG. 3 shows an enhanced Binaural Cue Coding (BCC) scheme with channel configuration information.

The binaural decoder introduced in the above-mentioned document "*Further information on binaural decoder functionality*", by Ojala P., Jakka J., is based on the BCC approach. The decoder input signal is created by an encoder, which combines a plurality of input audio channels (M) into one or more combined signals (S) and concurrently encodes the multi-channel sound image as BCC side information (SI) with the applicable HRTF parameters, as depicted in FIG. 3.

However, in contrast to multichannel loudspeaker reproduction, binaural reproduction allows more flexibility in the creation of an audio image. For instance, the complete 3-D space is available for sound source positioning, whereas the audio image of a multichannel loudspeaker configuration, such as the 5.1 surround, is limited to the azimuth (horizontal) plane of sparse resolution. In order to take advantage of the additional possibilities of binaural reproduction, a HRTF set, covering more directions than the default loudspeaker positions, is required, and a system for controlling the audio image is needed.

Accordingly, the encoder further creates channel configuration information (CC), i.e. audio source location information, which allows steering of the audio image when binaural reproduction is selected. The content creator generates this steering information, which is added into the bitstream. The audio source location information can be static throughout the audio presentation, whereby only a single information block is required in the beginning of the audio stream as header information. Alternatively, the audio scene may be dynamic, whereby location updates are included in the transmitted bit stream. The source location updates are variable rate by nature. Hence, utilizing arithmetic coding, the information can be coded efficiently for the transport, which is important in view of keeping the bitrate as low as possible.

Figure 4:
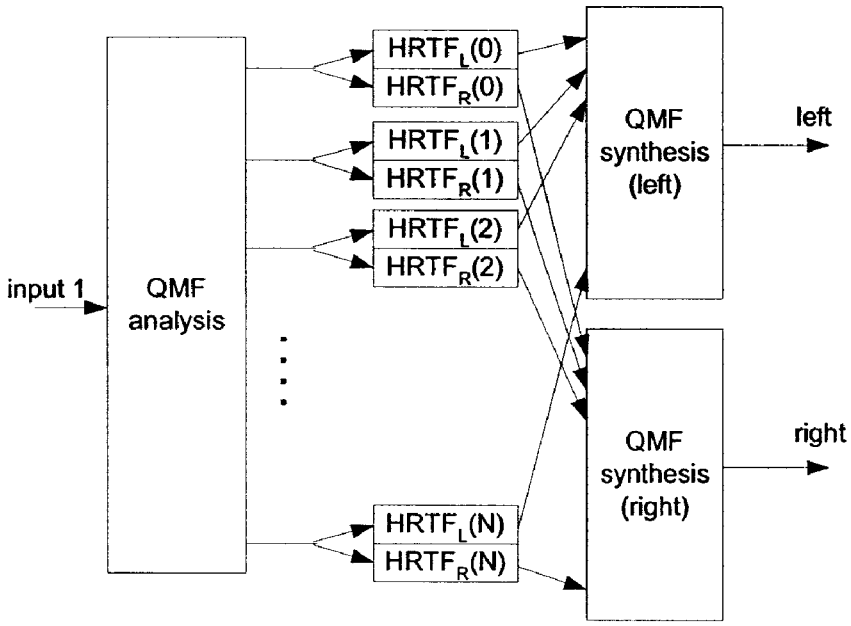
FIG. 4 shows a binaural decoding scheme with suitably selected HRTF filtering.

FIG. 4 illustrates the decoding process more in detail. The input signal consisting of either one or two downmixed audio channels (sum signals) is first transformed into QMF (Quadrature Mirror Filter) domain after which the spatial side information parameters together with HRTF parameters are applied to construct the a binaural audio. The binaural audio signals are then subjected to binaural downmix process, which, in turn, is controlled by the channel configuration information (CC). In the binaural downmix process, instead of HRTF filters corresponding to static loudspeaker positions, a filter pair for each audio source is selected based on the channel configuration information (CC) such that the used pairs of HRTFs are altered according to channel configuration information (CC), which alternations move the locations of the sound sources in the spatial audio image sensed by a headphones listener. In practice, a channel angle resolution of 10 degrees in horizontal plane and 30 degrees in vertical direction (elevation) is sufficient to allow for smooth movements of sound sources in the complete 3-D audio scene. After the HRTF filter pair is selected, the filtering is carried out as depicted in FIG. 4. Then QMF synthesis is applied to transform the binaural signal into the time domain.

Figure 5A:
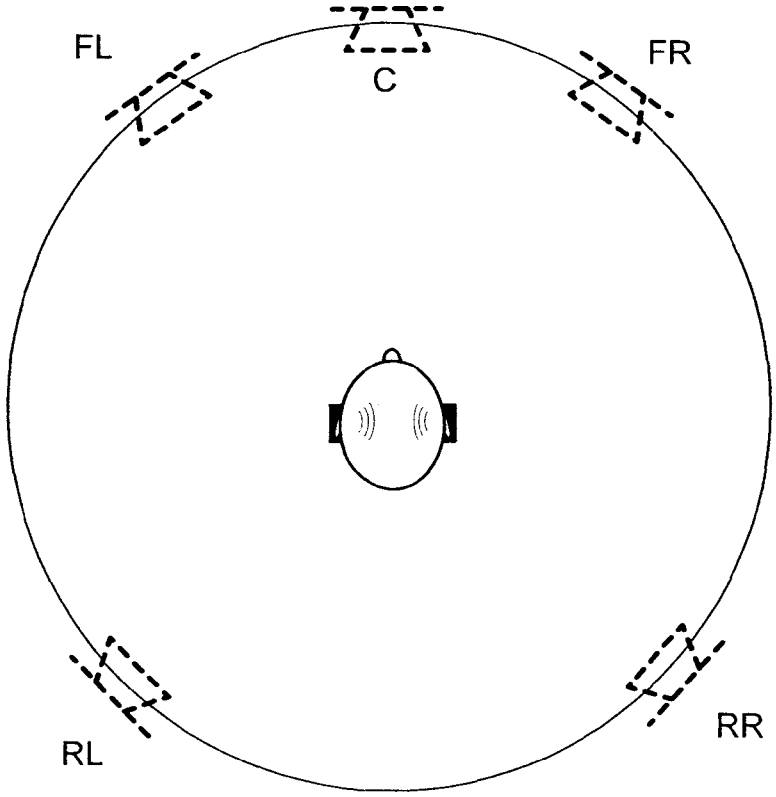
FIGS. 5*a*, 5*b* show examples of alternations of the locations of the sound sources in the spatial audio image in a horizontal plane.
Figure 5B:
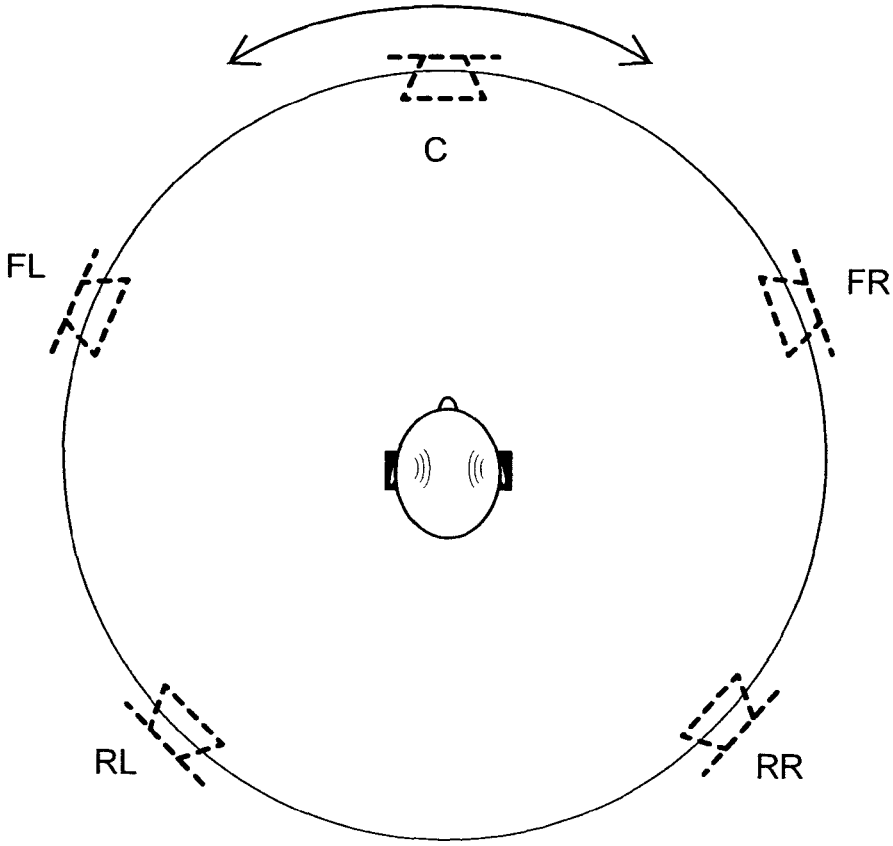

The horizontal (azimuth) alternations of the locations of the sound sources in the spatial audio image are illustrated in FIGS. 5*a* and 5*b*. In FIG. 5*a*, a spatial audio image is created for a headphones listener as a binaural audio signal, in which phantom loudspeaker positions (i.e. sound sources) are created in accordance with conventional 5.1 loudspeaker configuration. Loudspeakers in the front of the listener (FL and FR) are placed 30 degrees from the center speaker (C). The rear speakers (RL and RR) are placed 110 degrees calculated from the center. Due to the binaural effect, the sound sources appear to be in binaural playback with headphones in the same locations as in actual 5.1 playback.

In FIG. 5*b*, the spatial audio image is altered through rendering the audio image in the binaural domain such that the front sound sources FL and FR (phantom loudspeakers) are moved further apart to create an enhanced spatial image. The movement is accomplished by selecting a different HRTF pair for FL and FR channel signals according to the channel configuration information. Alternatively, any or all of the sound sources can be moved into a different position, even during the playback. Hence, the content creator has more flexibility to design a dynamic audio image when rendering the binaural audio content.

Figure 6:
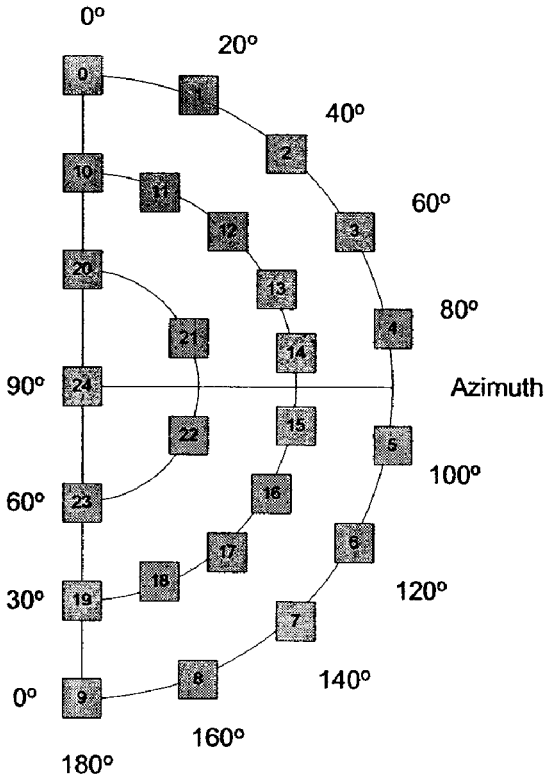
FIG. 6 shows a projection of possible sound source positions both in the horizontal and in the vertical plane.

FIG. 6 illustrates a projection of possible sound source positions both in the horizontal and in the vertical plane. The assumed listener is located in the origin of the projection. In this case the horizontal plane (0 degree elevation) as well as the next level with 30 degrees elevation has 20 degrees angular resolution. The resolution is dropped to 60 degrees when lifting the sound source location higher at 60 degrees elevation. Finally, there is only one position at a zenith directly above the listener. It should be noted that the left hand half of the hemisphere is not shown in the figure, but it is simply a mirrored copy of the projection in FIG. 6.

The examples in FIGS. 5*a*, 5*b* and 6 illustrate clearly the benefits, which are gained with the binaural decoder described above. Now the content creator is able to control the binaural downmix process in the decoder such that a more dynamic audio image can be designed for the binaural content than for loudspeaker representation with physically fixed loudspeaker positions. The spatial effect could be enhanced e.g. by moving the sound sources, i.e. virtual speakers, either in horizontal or in vertical plane. Sound sources could even be moved during the playback, thus enabling special audio effects.

However, in order to allow for smooth movements of sound sources, the decoder must contain a sufficient number of HRTF pairs to freely alter the locations of the sound sources in the spatial audio image both in the horizontal and in the vertical plane. For the binaural decoder described above, it has been concluded that successful audio image control requires sixty-four HRTF pairs in the upper hemisphere.

Now, a problem may arise from the fact that the decoder, however, may not have a full range of HRTF filter pairs to span the whole sphere (or hemisphere) or the resolution may be coarser than the content creator intended when creating the binaural rendering control. The binaural decoder standard does not mandate any particular HRTF set. Therefore, the content creation does not have any knowledge on the available HRTF filter database in the binaural decoder, whereby the resolution defined by the bit stream syntax may not be fully achieved.

A further problem arises, if the channel configuration information in the bitstream includes abrupt changes, i.e. movements, in the location of sound sources. As mentioned above, the bitrate of the control information should be kept as low as possible. Any abrupt change in the location of a sound source requires an additional codeword to be included in the bitstream, which codeword indicates the desired movement to the decoder. Due to the nature of differential coding of codewords it typically ensues that the greater the movement is, the longer is the codeword that is required to indicate the change. Consequently, any abrupt change in the location of a sound source increases the bitrate of the control information.

Now these problems can be avoided with an embodiment, according to which the decoder is arranged to search for the HRTF filter pair that is closest to the sound source location indicated in the channel configuration information in stepwise motion, whereby the angular velocity of the sound source movement is kept constant regardless of the actual source location resolution in the decoder. Since no abrupt changes, i.e. long codewords, are required to be indicated in the control information of the bitstream, the bitrate of the control information may advantageously be minimized. For example, the syntax of the control information may be simplified by leaving out the bits reserved especially for the long codewords indicating the abrupt movements.

According to an embodiment, the stepwise motion searching for the HRTF filter pair closest to the indicated sound source location is carried out as 10 degrees steps in the horizontal plane in all possible elevations. As indicated in FIG. 6, the resolution of sound source location is inevitably coarser with the higher elevations (e.g. over 45 degrees) than in the azimuth plane. Now, if the sound source movement indicated by the control information is only in the vertical direction, it may happen that there is no "higher" sound source location available in the corresponding horizontal angle. Thus, the closest HRTF filter pair available on the particular elevation must be searched, which is advantageously performed as incremental steps, preferably as 10 degrees steps, in the horizontal plane. Again, it can be assured that the best possible approximation of the desired sound source location is found without any additional control information.

Any person of skill in the art appreciates that the above-mentioned 10 degrees step is only an example of a suitable incremental step that can be used in searching for the best HRTF filter pair. Depending on the decoder structure, for example 20 degrees may be a suitable incremental step. Accordingly, any other suitable value may be used as the incremental step, preferably any value between 5 and 30 degrees.

The above embodiments provide significant advantages. Thanks to the constant angular velocity of the sound source movement in the horizontal plane, the bitrate of the control information can be minimized. Moreover, the dynamic binaural control is available even if the decoder contains only a limited set of HRTF filters. From the content creation point of view the dynamic control can be reliably utilized, since the best possible approximation of the audio image is always achieved.

A special case arises when the sound source is moved directly or close over the "zenith" of the hemisphere, whereby the needed angular velocity reaches infinity. For example, when the sound source is located in an angular direction of 45 degrees and the elevation angle is step-by-step increased to finally cross 90 degrees (at the zenith), the angular direction needs to be changed to 45±180=225 degrees. The change of 180 degrees is not necessarily possible with limited differential coding.

According to an embodiment, the decoder is arranged to monitor whether the singular position (zenith) is crossed in the sound source movement, and if affirmative, the decoder is arranged to computationally turn the horizontal angle of the sound source location by 180 degrees, i.e. the decoder adds 180 degrees to the desired source angle after singularity position is crossed. This computational operation enables a smooth continuation of the incremental stepwise motion.

According to an embodiment, this computational operation is carried out as a minor addition to the decoder software. The decoder implementation in differential location coding may be carried out for example as follows:

```
/* Read differential motion from the bit stream */
Angular_step = decode_angular(bit_stream) /* step in degrees */
Elevation_step = decode_elevation(bit_stream) /* step in
degrees */
/* Update the vertical angle */
Elevation_angle += Elevation_step;
/* Check crossing of singular position (zenith) */
If (Elevation_angle > 90) /* sound crosses singularity */
        Angular_angle_correction = 180;
Else
        Angular_angle_correction = 0;
/* Update the horizontal angle */
Angular_angle += Angular_step + Angular_angle_correction;
```

Accordingly, no absolute source location updates of 180 degrees are required, but the problem of handling the singularity position is handled with a straightforward computational operation.

Any person of skill in the art will appreciate that any of the embodiments described above may be implemented as a combination with one or more of the other embodiments, unless there is explicitly or implicitly stated that certain embodiments are only alternatives to each other.

Figure 7:
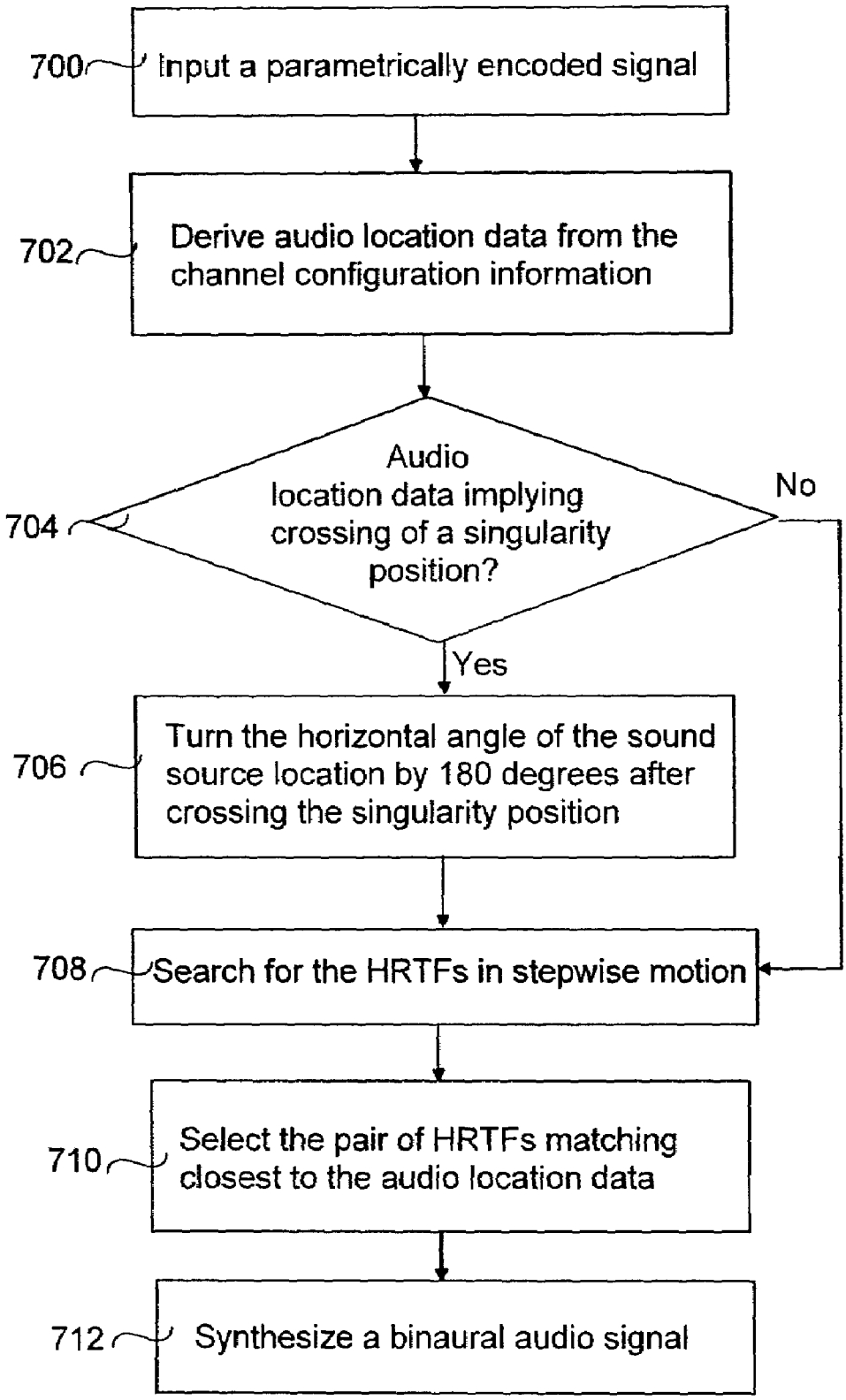
FIG. 7 shows an apparatus according to an embodiment of the invention in a simplified flow chart.

Some of the embodiments are further illustrated in a flow chart of FIG. 7, which is depicted from the viewpoint of the decoder operation. The starting point of the operation is that a parametrically encoded audio signal comprising at least one combined signal of a plurality of audio channels and one or more corresponding sets of side information, including also channel configuration information, is input (700) in the decoder. As described above, the channel configuration information comprises audio source location data, which describes the horizontal and/or vertical positions of the audio sources in the binaural audio signal. This audio source location data is derived (702) from the channel configuration information.

According to an embodiment, next the possible crossing of the singularity position is checked. Accordingly, the decoder monitors (704) whether the audio source location data implies such a sound source movement, which crosses the singular position (zenith) in the sound image. If such sound source movement is indicated in the audio source location data, the horizontal angle of the sound source location is turned (706) computationally by 180 degrees after the singular position is crossed.

Regardless of whether the handling of the singularity position is required or not, the decoder continues to search (708) for the left-right pair of the HRTF filters in stepwise motion in the horizontal plane from a predetermined set of head-related transfer function filters. Then the left-right pair of the HRTF filters, which matches closest to the audio source location data is selected (710). Finally, a binaural audio signal is synthesized (712) from the at least one processed signal according to the side information and the channel configuration information such that the sound sources are reproduced at least approximately in their correct positions, as indicated by the audio source location data.

The above embodiments of searching the best HRTF filter pair with incremental steps and handling the singularity position can be carried out as decoder-specific features, whereby the decoder is arranged to automatically select the best HRTF filter pair after searching it with predefined steps without any instructions from the encoder. However, at least the use of the incremental steps may, in some occasions, be controlled by the content creator, whereby the desired incremental steps and their direction may be included in the channel configuration information (CC) of the bitstream received from the encoder. It is also possible that the content creator includes an update of absolute source location with 180 degrees into the bitstream and thereby controls directly the turning of the horizontal angle of the sound source location without any decoder intervention. This, however, requires codewords, which are long enough to indicate the 180 degrees change, i.e. the bitrate of the control information is increased.

Consequently, an aspect of the invention relates to a parametric audio encoder for generating a parametrically encoded audio signal from a multi-channel audio signal comprising a plurality of audio channels. The encoder generates at least one combined signal of the plurality of audio channels. Additionally, the encoder generates one or more corresponding sets of side information including channel configuration information for controlling audio source locations in a synthesis of a binaural audio signal. The channel configuration information, in turn, includes information for searching a left-right pair of HRTF filters matching closest to the audio source location data in stepwise motion during the synthesis of the binaural audio signal. Consequently, the content creator is able to control the binaural downmix process and the use of the incremental steps in the decoder. The spatial effect could be enhanced e.g. by moving the sound sources (virtual speakers) further apart from the center (median) axis. In addition, one or more sound sources could be moved during the playback, thus enabling special audio effects. Hence, the content creator has more freedom and flexibility in designing the audio image for the binaural content than for loudspeaker representation with (physically) fixed loudspeaker positions.

The encoder may be, for example, a BCC encoder known as such, which is further arranged to calculate the channel configuration information, either in addition to or instead of, the inter-channel cues ICTD, ICLD and ICC describing the multi-channel sound image. The encoder may encode the channel configuration information within the gain estimates, or as a single information block in the beginning of the audio stream, in case of static channel configuration, or if dynamic configuration update is used, in a separate field included occasionally in the transmitted bit stream. Then both the sum signal and the side information, plus the channel configuration information, are transmitted to the receiver side, preferably using an appropriate low bitrate audio coding scheme for coding the sum signal.

Since the bitrate required for the transmission of one combined channel and the necessary side information is very low, the invention is especially well applicable in systems, wherein the available bandwidth is a scarce resource, such as in wireless communication systems. Accordingly, the embodiments are especially applicable in mobile terminals or in other portable device typically lacking high-quality loudspeakers, wherein the features of multi-channel surround sound can be introduced through headphones listening the binaural audio signal according to the embodiments. A further field of viable applications include teleconferencing services, wherein the participants of the teleconference can be easily distinguished by giving the listeners the impression that the conference call participants are at different locations in the conference room.

Figure 8:
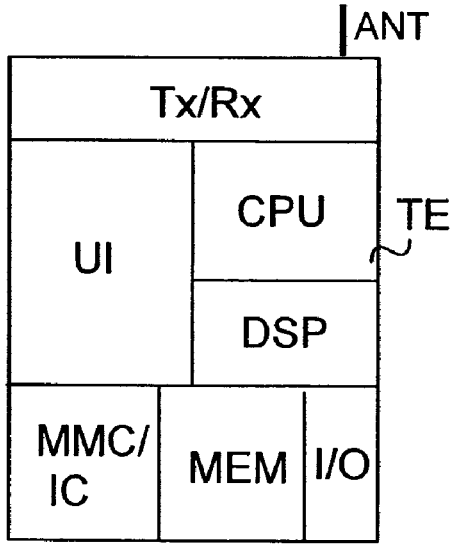
FIG. 8 shows a simplified structure of a data processing device.

FIG. 8 illustrates a simplified structure of a data processing device (TE), wherein the binaural decoding system according to the invention can be implemented. The data processing device (TE) can be, for example, a mobile terminal, a PDA device or a personal computer (PC). The data processing unit (TE) comprises I/O means (I/O), a central processing unit (CPU) and memory (MEM). The memory (MEM) comprises a read-only memory ROM portion and a rewriteable portion, such as a random access memory RAM and FLASH memory. The information used to communicate with different external parties, e.g. a CD-ROM, other devices and the user, is transmitted through the I/O means (I/O) to/from the central processing unit (CPU). If the data processing device is implemented as a mobile station, it typically includes a transceiver Tx/Rx, which communicates with the wireless network, typically with a base transceiver station (BTS) through an antenna. User Interface (UI) equipment typically includes a display, a keypad, a microphone and connecting means for headphones. The data processing device may further comprise connecting means MMC, such as a standard form slot, for various hardware modules or as integrated circuits IC, which may provide various applications to be run in the data processing device.

Accordingly, the binaural decoding system according to the invention may be executed in a central processing unit CPU or in a dedicated digital signal processor DSP (a parametric code processor) of the data processing device, whereby the data processing device receives a parametrically encoded audio signal comprising at least one combined signal of a plurality of audio channels and one or more corresponding sets of side information describing a multi-channel sound image and including channel configuration information for controlling audio source locations in a synthesis of a binaural audio signal. The parametrically encoded audio signal may be received from memory means, e.g. a CD-ROM, or from a wireless network via the antenna and the transceiver Tx/Rx. The processing unit (DSP or CPU) derives audio source location data describing horizontal and/or vertical positions of audio sources in the binaural audio signal from the channel configuration information. The data processing device further comprises a predetermined set of head-related transfer function filters, from which a left-right pair of head-related transfer function filters matching closest to the audio source location data is selected such that the left-right pair of head-related transfer function filters is searched in stepwise motion in horizontal plane. Finally, the data processing device further comprises a synthesizer for synthesizing a binaural audio signal from the at least one processed signal according to side information and said channel configuration information. The binaural audio signal is then reproduced via the headphones.

The decoder can be implemented in the data processing device TE as an integral part of the device, i.e. as an embedded structure, or the decoder may be a separate module, which comprises the required decoding functionalities and which is attachable to various kind of data processing devices. The required decoding functionalities may be implemented as a chipset, i.e. an integrated circuit and a necessary connecting means for connecting the integrated circuit to the data processing device.

Likewise, the encoding system according to the invention may as well be executed in a central processing unit CPU or in a dedicated digital signal processor DSP of the data processing device, whereby the data processing device generates a parametrically encoded audio signal comprising at least one combined signal of a plurality of audio channels and one or more corresponding sets of side information including channel configuration information for controlling audio source locations in a synthesis of a binaural audio signal, said channel configuration information including information for searching, from a predetermined set of head-related transfer function filters, a left-right pair of head-related transfer function filters matching closest to the audio source location data in stepwise motion during the synthesis of the binaural audio signal.

The functionalities of the invention may be implemented in a terminal device, such as a mobile station, also as a computer program which, when executed in a central processing unit CPU or in a dedicated digital signal processor DSP, affects the terminal device to implement procedures of the invention. Functions of the computer program (software (SW)) may be distributed to several separate program components communicating with one another. The computer software may be stored into any memory means, such as the hard disk of a PC or a DVD or CD-ROM disc, flash memory, or the like, from where it can be loaded into the memory of mobile terminal. The computer software can also be loaded through a network, for instance using a TCP/IP protocol stack.

It is also possible to use hardware solutions or a combination of hardware and software solutions to implement the inventive means. Accordingly, the above computer program product can be at least partly implemented as a hardware solution, for example as ASIC or FPGA circuits, in a hardware module comprising connecting means for connecting the module to an electronic device, or as one or more integrated circuits IC, the hardware module or the ICs further including various means for performing said program code tasks, said means being implemented as hardware and/or software.

It should be understood that the present invention is not limited solely to the above-presented embodiments, but it can be modified within the scope of the appended claims.

The invention claimed is:

1. A method comprising:

inputting a parametrically encoded audio signal comprising at least one combined signal of a plurality of audio channels and one or more corresponding sets of side information describing a multi-channel sound image and including channel configuration information;

deriving, from said channel configuration information, audio source location data describing at least one of horizontal and vertical positions of audio sources in the audio signal;

selecting, from a predetermined set of head-related transfer function filters, a left-right pair of head-related transfer function filters matching closest to the audio source location data, wherein the left-right pair of head-related transfer function filters is searched in a stepwise motion in a horizontal plane; and synthesizing a binaural audio signal from the at least one processed signal according to side information and said channel configuration information.

2. The method according to claim 1, further comprising:

keeping angular velocity control of the sound source movement constant; and searching the left-right pair of head-related transfer function filters matching closest to the audio source location data.

3. The method according to claim 1, wherein:

the stepwise motion is carried out as ten degree or twenty degree steps in the horizontal plane in a plurality of elevations.

4. The method according to claim 1, further comprising:

monitoring whether the audio source location data implies a sound source movement crossing a singularity position in the sound image; and if affirmative, turning computationally a horizontal angle of a sound source location by one hundred and eighty degrees after the singularity position is crossed.

5. The method according to claim 1, wherein said set of side information further comprises inter-channel cues used in binaural cue coding scheme, such as inter-channel time difference, inter-channel level difference and inter-channel coherence.

6. The method according to claim 5, wherein the step of synthesizing a binaural audio signal further comprises:

synthesizing a plurality of audio signals of the plurality of audio channels from the at least one combined signal in a binaural cue coding synthesis process, which is controlled according to said one or more corresponding sets of side information; and applying the plurality of synthesized audio signals to a binaural downmix process.

7. An apparatus comprising:

a parametric code processor for processing a parametrically encoded audio signal comprising at least one combined signal of a plurality of audio channels and one or more corresponding sets of side information describing a multi-channel sound image and including channel configuration information, wherein audio source location data describing at least one of horizontal and vertical positions of audio sources in the audio signal is derived from said channel configuration information;

a predetermined set of head-related transfer function filters, from which a left-right pair of head-related transfer function filters matching closest to the audio source location data is arranged to selected such that the left-right pair of head-related transfer function filters is searched in a stepwise motion in a horizontal plane; and a synthesizer for synthesizing a binaural audio signal from the at least one processed signal according to side information and said channel configuration information.

8. The apparatus according to claim 7, further comprising:

a processing unit for keeping angular velocity control of the sound source movement constant and for searching the left-right pair of head-related transfer function filters matching closest to the audio source location data.

9. The apparatus according to claim 7, wherein:

the stepwise motion is carried out as ten degree or twenty degree steps in a horizontal plane in a plurality of elevations.

10. The apparatus according to claim 7, wherein said processing unit is arranged to:

monitor whether the audio source location data implies a sound source movement crossing a singular position (zenith) in the sound image; and if affirmative, turn computationally a horizontal angle of a sound source location by one hundred and eighty degrees after the singularity position is crossed.

11. The apparatus according to claim 7, wherein said set of side information further comprises inter-channel cues used in binaural cue coding scheme, such as inter-channel time difference, inter-channel level difference and inter-channel coherence.

12. The apparatus according to claim 11, wherein:

said synthesizer is arranged to synthesize a plurality of audio signals of the plurality of audio channels from the at least one combined signal in a binaural cue coding synthesis process, which is controlled according to said one or more corresponding sets of side information; and the apparatus further comprises a binaural downmix unit, to which the plurality of synthesized audio signals are applied for synthesizing a binaural audio signal according to said channel configuration information.

13. The apparatus according to claim 7, said apparatus being a mobile terminal, a personal digital assistant device or a personal computer.

14. A computer program product, stored on a non-transitory computer readable medium and executable in a data processing device, for processing a parametrically encoded audio signal comprising at least one combined signal of a plurality of audio channels and one or more corresponding sets of side information describing a multi-channel sound image and including channel configuration information, the computer program product comprising:

a computer program code section for deriving, from said channel configuration information, audio source location data describing at least one of horizontal and vertical positions of audio sources in the audio signal;

a computer program code section for selecting, from a predetermined set of head-related transfer function filters, a left-right pair of head-related transfer function filters matching closest to the audio source location data, wherein the left-right pair of head-related transfer function filters is searched in a stepwise motion in a horizontal plane; and a computer program code section for synthesizing a binaural audio signal from the at least one processed signal according to side information and said channel configuration information.

15. A module, attachable to a data processing device and comprising an audio encoder, the audio encoder comprising:

a parametric code processor for processing a parametrically encoded audio signal comprising at least one combined signal of a plurality of audio channels and one or more corresponding sets of side information describing a multi-channel sound image and including channel configuration information, wherein audio source location data describing at least one of horizontal and vertical positions of audio sources in the binaural audio signal is derived from said channel configuration information;

a predetermined set of head-related transfer function filters, from which a left-right pair of head-related transfer function filters matching closest to the audio source location data is arranged to be selected such that the left-right pair of head-related transfer function filters is searched in a stepwise motion in a horizontal plane; and a synthesizer for synthesizing a binaural audio signal from the at least one processed signal according to side information and said channel configuration information.

16. The module according to claim 15, wherein:

the module is implemented as a chipset.

17. A method for generating a parametrically encoded audio signal, the method comprising:

inputting a multi-channel audio signal comprising a plurality of audio channels;

generating at least one combined signal of the plurality of audio channels; and generating one or more corresponding sets of side information including channel configuration information for controlling audio source locations in a synthesis of a binaural audio signal, said channel configuration information including information for searching, from a predetermined set of head-related transfer function filters, a left-right pair of head-related transfer function filters matching closest to the audio source location data in a stepwise motion during the synthesis of the binaural audio signal.

18. The method according to claim 17, wherein said audio source locations are static throughout a binaural audio signal sequence, the method further comprising:

including said channel configuration information as an information field in said one or more corresponding sets of side information corresponding to said binaural audio signal sequence.

19. The method according to claim 17, wherein said audio source locations are variable, the method further comprising:

including said channel configuration information in said one or more corresponding sets of side information as a plurality of information fields reflecting variations in said audio source locations.

20. The method according to claim 17, wherein said set of side information further comprises inter-channel cues used in binaural cue coding scheme, such as inter-channel time difference, inter-channel level difference and inter-channel coherence.

21. A parametric audio encoder for generating a parametrically encoded audio signal, the encoder comprising:

means for inputting a multi-channel audio signal comprising a plurality of audio channels;

means for generating at least one combined signal of the plurality of audio channels; and means for generating one or more corresponding sets of side information including channel configuration information for controlling audio source locations in a synthesis of a binaural audio signal, said channel configuration information including information for searching, from a predetermined set of head-related transfer function filters, a left-right pair of head-related transfer function filters matching closest to audio source location data in a stepwise motion during the synthesis of the binaural audio signal.

22. The encoder according to claim 21, further comprising:

means for including said channel configuration information as an information field in said one or more corresponding sets of side information corresponding to a binaural audio signal sequence, when said audio source locations are static throughout said binaural audio signal sequence.

23. The encoder according to claim 21, further comprising:

means for including said channel configuration information in said one or more corresponding sets of side information as a plurality of information fields reflecting variations in said audio source locations, when said audio source locations are variable.

24. A computer program product, stored on a non-transitory computer readable medium and executable in a data processing device, for generating a parametrically encoded audio signal, the computer program product comprising:

a computer program code section for inputting a multi-channel audio signal comprising a plurality of audio channels;

a computer program code section for generating at least one combined signal of the plurality of audio channels; and a computer program code section for generating one or more corresponding sets of side information including channel configuration information for controlling audio source locations in a synthesis of a binaural audio signal, said channel configuration information including information for searching, from a predetermined set of head-related transfer function filters, a left-right pair of head-related transfer function filters matching closest to the audio source location data in a stepwise motion during the synthesis of the binaural audio signal.

* * * * *